United States Patent [19]

Oguma et al.

[11] 4,304,016

[45] Dec. 8, 1981

[54] SANITARY CLEANSING SPRAYING DEVICE FOR USE IN TOILETS

[75] Inventors: Tomio Oguma, Anjo; Shinji Kawai, Toyota; Hisanobu Takeda, Aichi, all of Japan

[73] Assignee: Aisin Seiki Kabushiki Kaisha, Kariya, Japan

[21] Appl. No.: 95,669

[22] Filed: Nov. 19, 1979

[30] Foreign Application Priority Data

| | | | |
|---|---|---|---|
| Nov. 21, 1978 | [JP] | Japan | 53-144541 |
| Nov. 21, 1978 | [JP] | Japan | 53-144543 |
| Nov. 24, 1978 | [JP] | Japan | 53-145526 |

[51] Int. Cl.[3] ..... A47K 4/00; A47K 3/02

[52] U.S. Cl. ..... 4/420.2; 4/420.4; 4/443; 4/448

[58] Field of Search ..... 4/420.2, 420.4, 447, 4/443, 448

[56] References Cited

U.S. PATENT DOCUMENTS

| | | | |
|---|---|---|---|
| 2,094,170 | 9/1937 | Heald | 4/420.2 |
| 3,195,148 | 7/1965 | Merkel, Jr. | 4/447 |
| 3,247,524 | 4/1966 | Umann | 4/447 |
| 3,570,015 | 3/1971 | Rosengaus | 4/420.4 |
| 3,605,124 | 9/1971 | Marcard et al. | 4/420.2 |
| 3,914,804 | 10/1975 | Schrader et al. | 4/420.4 X |
| 4,068,325 | 1/1978 | Benthin | 4/420.4 |
| 4,181,985 | 1/1980 | Rius | 4/420.4 X |

*Primary Examiner*—Henry K. Artis

*Attorney, Agent, or Firm*—Finnegan, Henderson, Farabow, Garrett and Dunner

[57] ABSTRACT

A sanitary cleansing spraying device for use in toilets which includes a retractable spray nozzle connected through a control valve with a heated water reservoir which is in turn connected with a submerged water pump in the flushing water tank. The control valve and the spray nozzle are connected with a flushing lever so that the control valve is opened and the spray nozzle is moved to a spray position. The spray nozzle has two spray positions and in one of the two positions water is sprayed with a lower pressure than in the other position so that the device can be used as a bidet.

7 Claims, 14 Drawing Figures

SANITARY CLEANSING SPRAYING DEVICE FOR USE IN TOILETS

The present invention relates to sanitary cleansing spraying devices for use in toilets and more particularly to sanitary cleansing spraying devices for use in toilet bowls.

Conventional types of sanitary cleansing devices for use in toilet bowls generally include water supplying conduits which are provided with control valves and preheating units for raising the temperature of water which is being sprayed. For example, the U.S. Pat. No. 4,068,325 issued on Jan. 17, 1978 to Johonnes Benthin discloses a spraying device for use in toilets which comprises a spraying head provided on a support arm which is mounted on the toilet for pivotable movement between an extended position in which the spraying head is located in the central portion of the toilet bowl for cleansing spray and a retracted position in which the spraying head is retracted so that it is protected from soiling. The support arm is in the form of a pipe for supplying cleansing water to the spraying head and for the purpose connected with a main conduit which includes a control valve and a preheating device.

In this type of sanitary cleansing spraying device, inconveniencies are encountered in that the spraying water pressure is still dependent on the pressure of the water supply to the main conduit even though the control valve is interposed in the main conduit. Further, the temperature of the spray water will be changed in response to a change in the water flow. Thus, even during a use of the device, the spray water temperature may be changed due to a possible fluctuation of the pressure of the water supply.

It is therefore an object of the present invention to provide a sanitary cleansing spray device for use in toilets in which water spray pressure can be controlled substantially independently from the pressure of water supply.

Another object of the present invention is to provide a sanitary cleansing spray device for use in toilets in which the temperature of spray water can be maintained during the spray period.

A further object of the present invention is to provide a sanitary cleansing spray device in which means is provided for preventing undesirable leakage of water during inoperative periods.

Still further object of the present invention is to provide a sanitary cleansing spray device for use in toilets which can also be used as a bidet.

Yet further object of the present invention is to provide a sanitary cleansing spray device for use in toilets which is provided with means for changing the water spray pressure so that it can be used also as a bidet.

According to the present invention, in order to accomplish the above and other objects, there is provided a sanitary cleansing spraying device which comprises reservoir means for heated water, means for providing a supply of water to said heated water reservoir means, spray nozzle means provided on support means to extend into a toilet bowl and movable between a spray position in which it is located in the toilet so that it can direct a spray of water to a portion of a body sitting on the toilet bowl and a retracted position in which it is prevented from soiling, said spray means being connected with said heated water reservoir means through manually operated flow control valve means, means for forcing water in the heated water reservoir means through said valve means to said spray nozzle means. In a preferable mode of the present invention, there is provided second valve means between said heated water reservoir means and the spray nozzle means so that it is opened when the spray nozzle means is moved to the spray position. The arrangement may be such that the water in the heated water reservoir means is forced to flow to the spray nozzle means by the water introduced into the reservoir means by the water supply means.

Usually, a toilet bowl is associated with a flush water container. In such a case, the water forcing means may be composed of a submerged type water pump which is provided in the flush water container and connected through a conduit to the heated water reservoir preferably at the bottom portion thereof. Means may further be provided for heating the water in the heated water reservoir means. Switch means for energizing the water pump may be so located that it is actuated when the spray nozzle means is moved to the spray position.

In a further preferable mode of the present invention, the spray nozzle means is mounted for movement from the spray position further to a second spray position and the second valve means is provided with flow restriction means for restricting water flow to the spray nozzle means when the spray nozzle means is in the second spray position so that the device can be used as a bidet. The heated water reservoir means may include a closed container which is mounted at a side of the toilet bowl and the support means for the spray nozzle means may be composed of a pipe which extends from the container sidewardly to the toilet bowl. The pipe supports the spray nozzle means at one end thereof and constitutes conduit means for leading water to the spray nozzle means. At the other end, the pipe is connected with the second valve means which is in the form of a rotatable valve mounted on the container for rotation about its own axis. The connection between the rotatable valve and the conduit pipe is such that the pipe is also rotated as the valve is rotated. Since the pipe is of a curved configuration, the nozzle means is swingably moved between the retracted position and the first and second spray positions. The rotatable valve is formed with a larger first port which connects the container with the conduit pipe when the nozzle means is in the first spray position and a restricted second port which connects the container with the conduit pipe when the nozzle means is in the second spray position.

The above and other objects and features of the present invention will become apparent from the following descriptions of a preferred embodiment taking reference to the accompanying drawings, in which.

Figure 1:
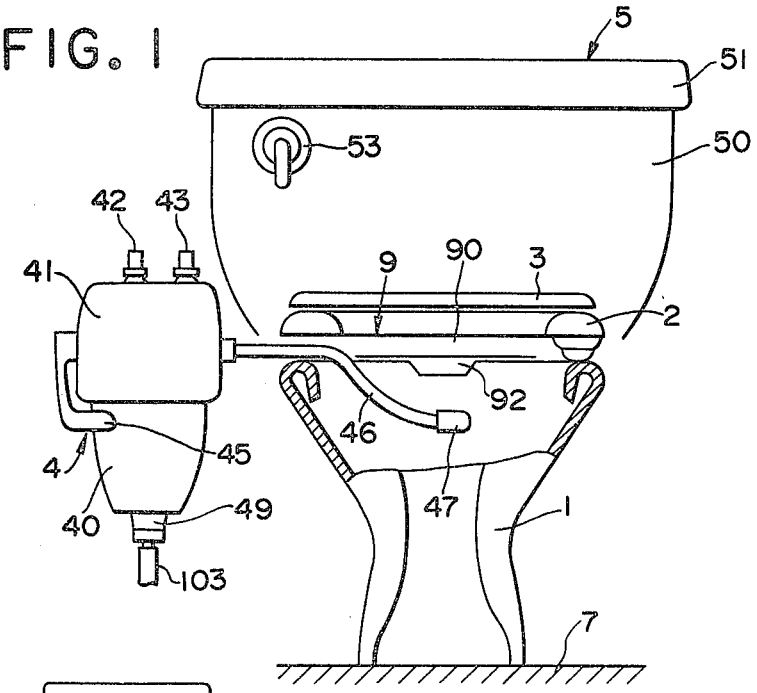
FIG. 1 is a partially cut-away front view of a toilet having a spraying device in accordance with one embodiment of the present invention.
Figure 2:
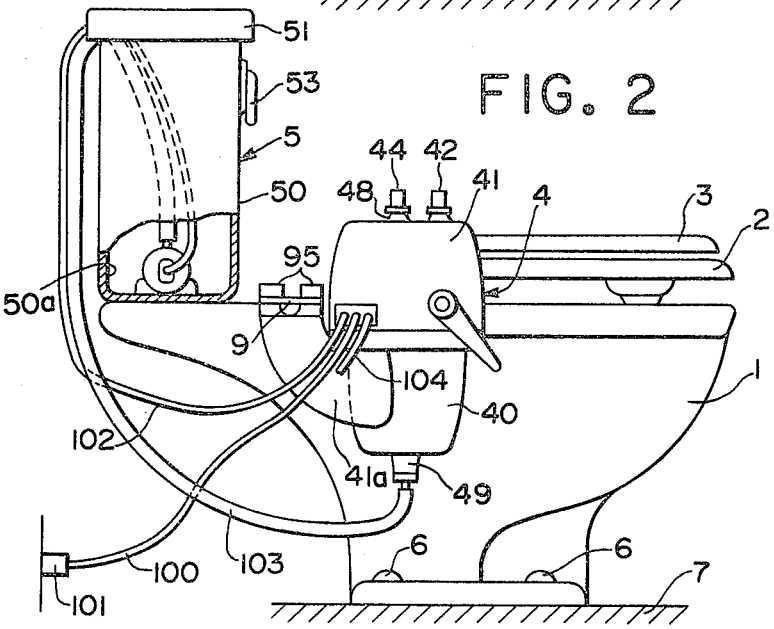
FIG. 2 is a side view of the toilet shown in FIG. 1.
Figure 3:
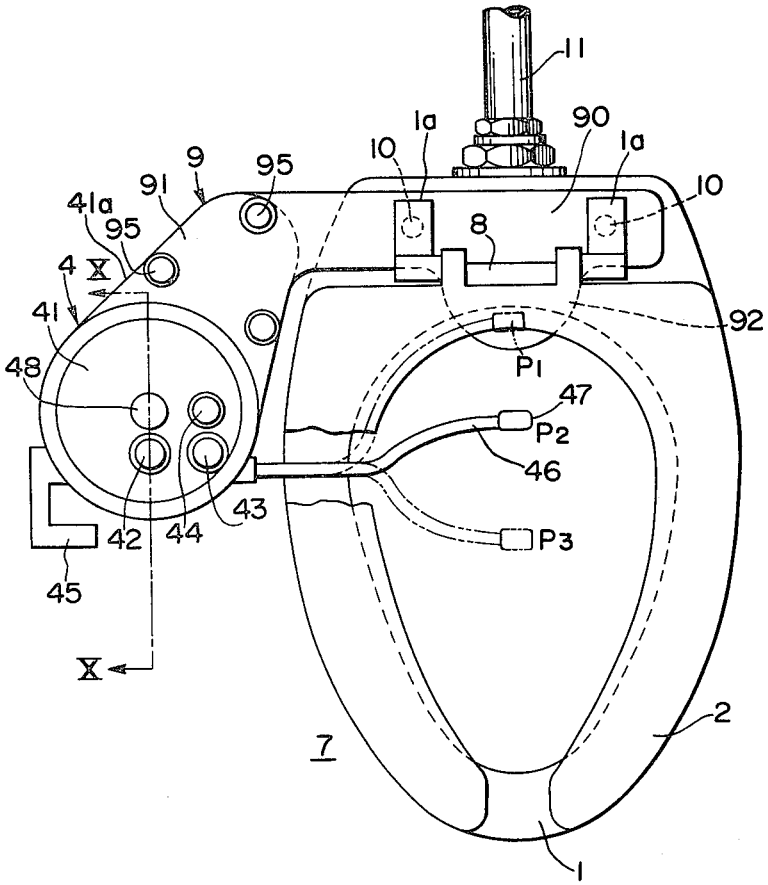
FIG. 3 is a plan view of the toilet shown in FIGS. 1 and 2.

Referring now to the drawings, particularly to FIGS. 1 through 3, the toilet shown therein includes a toilet bowl 1, a toilet seat 2 and a lid 3. The toilet seat 2 and the lid 3 are connected to the toilet bowl 1 by means of a hinge bracket 1*a* through a hinge pin 8. At one side of the toilet bowl 1, there is provided a heated water reservoir 4 and a flush water tank 5 is provided at the backside of the toilet bowl 1. As shown in FIG. 2, the toilet bowl 1 is secured to the floor 7 by means of bolts 6.

Figure 7:
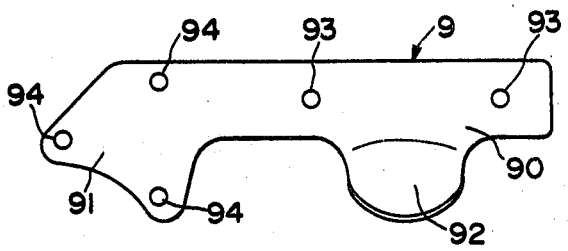
FIG. 7 is a plan view showing a plate provided for mounting the heated water reservoir.

The hinge bracket 1*a* is mounted on the toilet bowl 1 at the rear end portion thereof by means of bolts 10 with a reservoir mounting plate 9 interposed therebetween. As shown in FIG. 7, the mounting plate 9 has a base portion 90 and a sideward extension 91 and is attached to the toilet bowl 1 at the base portion 90. For the purpose, the base portion of the mounting plate 9 is formed with two spaced apart holes 93 for passing the bolts 10 therethrough. In the extension 91, the plate 9 is formed with three attachment holes 94 which are adapted for inserting bolts 95 for mounting the reservoir 4 on the plate 9. In FIG. 7, it will further be noted that the mounting plate 9 is formed with a shield portion 92 which extends forwardly from the base portion 90. As in conventional toilets, the toilet bowl 1 is connected with the flushing water tank 5 by means of a conduit 11 so that the bowl 1 is flushed by the water from the tank 5.

Figure 9:
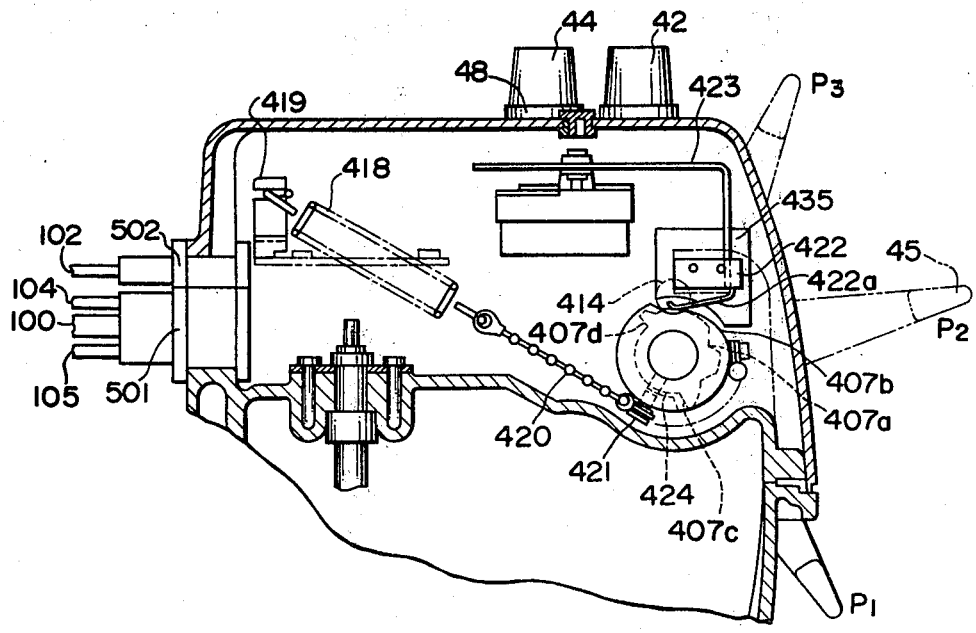
FIG. 9 is a fragmentary sectional view of the heated water reservoir taken along the line IX—IX in FIG. 8.
Figure 8:
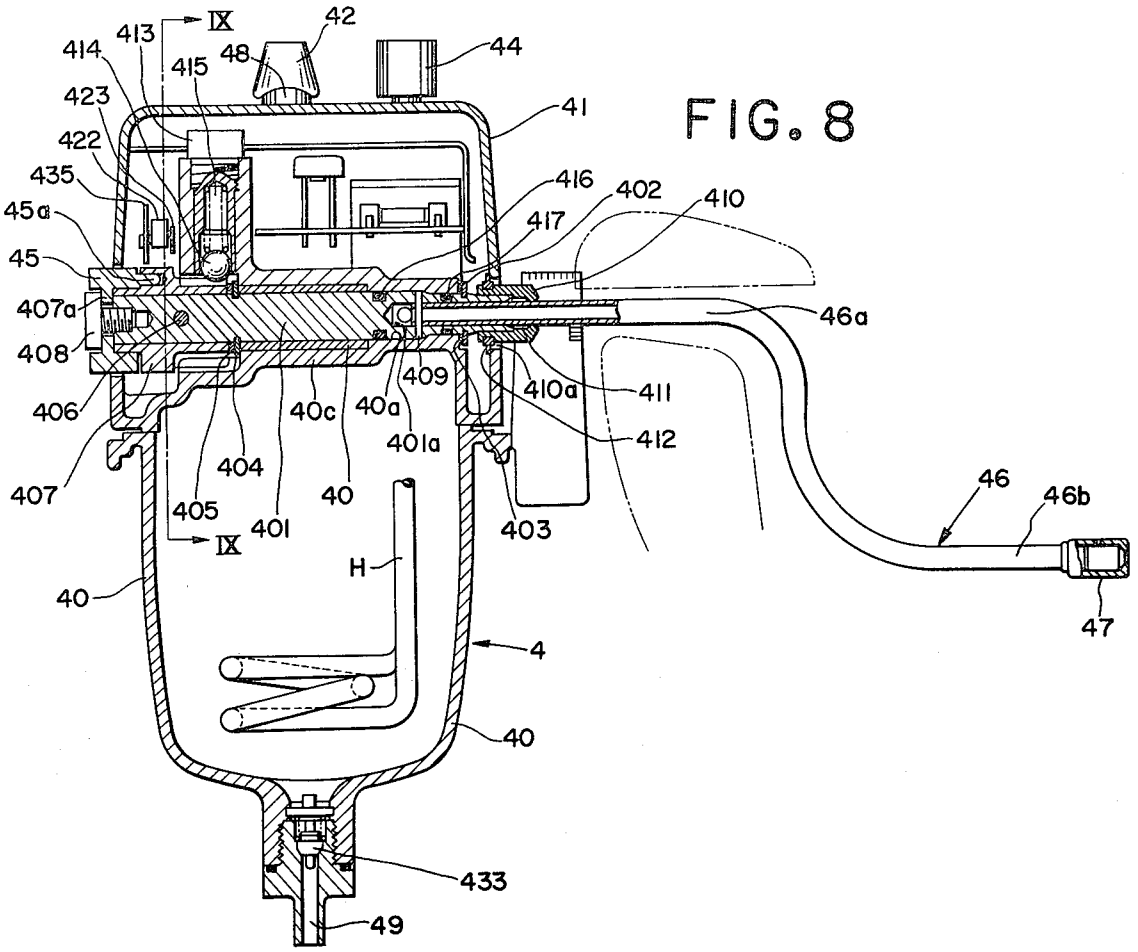
FIG. 8 is a sectional view of the heated water reservoir showing the inside arrangement thereof.
Figure 10:
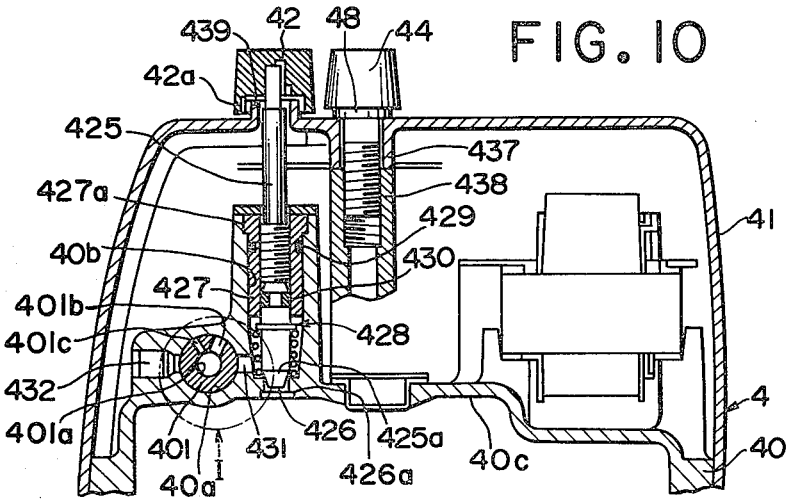
FIG. 10 is a fragmentary sectional view in an enlarged scale of the heated water reservoir taken along the line X—X in FIG. 3.

Referring now to FIGS. 6, 8, 9 and 10, it will be noted that the heated water reservoir 4 comprises a lower container 40 which has a top wall 40*c*. A cover lid 41 is mounted on the container 40 to provide a space between the container 40 and the cover 41. As shown in FIG. 10, the container 40 is formed with a post 438 which is projecting upwardly from the top wall 40*c* and the lid 41 is formed at its inner surface with a downward projection 437 which is brought into an abutting engagement with the post 438. A bolt 48 is threaded through the projection 437 in the lid 41 into the post 438 of the container 40 for securing the cover lid 41 to the container 40. As clearly shown in FIG. 6, the lower container 40 is formed with a rearwardly extending stay portion 41*a* which is adapted to be attached to the extension 91 of the mounting plate 9 by means of the aforementioned bolts 95 for mounting the heated water reservoir 4 on the plate. In the container 40, there is provided a heating coil H as shown in FIG. 8 for heating water in the container 40. The heating coil H may be composed of a coil of a conduit for a heating medium or an insulated electrical heating wire.

On the cover lid 41, there are provided a water control knob 42, a seat heater control knob 43 and a power switching knob 44. Referring again to FIG. 10, it will be noted that the lid 41 is formed with an annual upward projection 439 with an opening therein. The control knob 42 has an annular skirt 42*a* which encircles the annular projection 439 on the lid 41. The knob 42 is attached to the top end of a rod 425 which extends through the opening in the annular projection 439. The other control knobs 43 and 44 are mounted in similar ways. The arrangements are effective to prevent water splash from entering the space between the lower container 40 and the lid 41 through the opening in the annular projection 439.

As shown in FIGS. 9 and 10, the top wall 40*c* of the lower container 40 is formed with a transversely extending bore 40*a* and a cylindrical valve member 401 is received in the bore 40*a*. In the top wall 40*c* of the container 40, there is a metallic collar 40*d* which is axially aligned with the bore 40*a* and the valve member 401 also extends through the collar 40*d*. The valve member 401 has an axial bore 401*a* and is axially retained in one direction by an E-ring 403 which acts on the valve member 401 through a washer 402 and in the other direction by an E-ring 405 which acts on the valve member 401 through a washer 404.

The valve member 401 extends outwardly beyond the collar 40*d* and has a sleeve 407 which is secured to the valve member 401 by means of a retaining pin 406. A control or actuating lever 45 is mounted to the outer end of the valve member 401 by means of a bolt 408. In order that the control lever 45 is secured to the sleeve 407 and therefore to the valve member 401, the lever 45 is formed with an axial projection 45*a* which is engaged with a corresponding recess in the sleeve 407 as shown in FIG. 8. A nozzle support pipe 46 having a spray nozzle 47 at one end is connected at the other end to the valve member 401. For the purpose, the valve member 401 is formed at the end adjacent to the toilet bowl 1 with an axial bore 401*a* and the aforementioned other end of the pipe 46 is inserted into the bore 401*a*. The end of the pipe 46 is cut to form a V-shaped cut-off and a pin 409 is inserted through the valve member 401 and the V-shaped cut-off of the pipe 46 so that the pipe 46 is rotated together with the valve member 401 upon actuation of the control lever 45.

A nut 410 is threadably engaged with the valve member 401 at the end adjacent to the toilet bowl 1 with an O-ring 411 interposed therebetween. The nut 410 further carries a sealing disc 412 which is made of a resilient material such as a rubber and mounted on the nut 410 at a peripheral groove 410*a* for preventing splash of water from entering inside the lid 41. O-ring 416 and 417 are appropriately provided around the valve member 401 to prevent water leakage.

Figure 4:
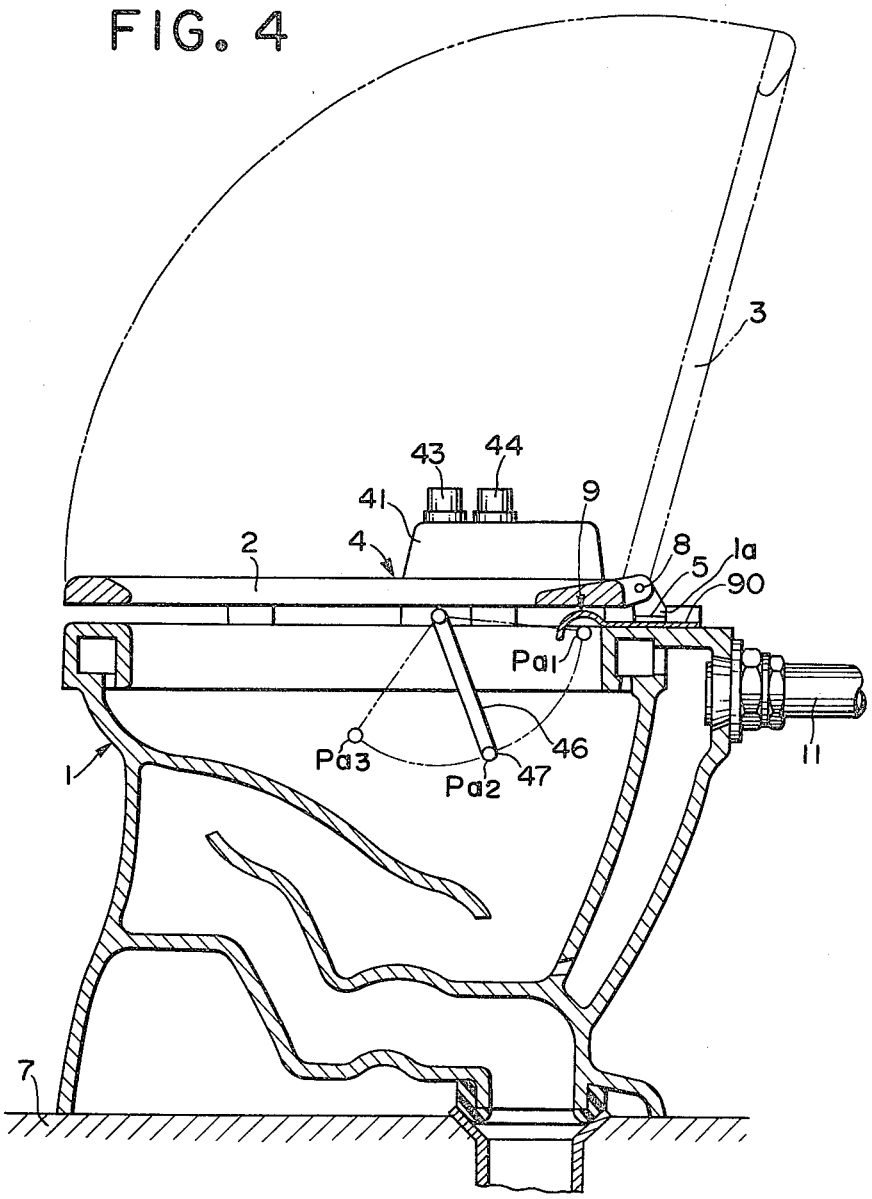
FIG. 4 is a vertical sectional view of the toilet bowl showing the positions to which the spray nozzle is movable.

The pipe 46 is of a curved configuration as shown in FIG. 8 so that the spray nozzle 47 is moved from a retracted position $Pa_1$ to a first spray position $Pa_2$ and also to a second spray portion $Pa_3$ upon actuation of the control lever 45. In the retracted position $Pa_1$, the nozzle 47 is located directly beneath the shield portion 92 of the mounting plate 9 as shown in FIG. 4 so that it is protected from soiling.

Referring further to FIG. 8, it will be noted that a sleeve 413 is fitted to the top wall 40*c* of the container 40. In the sleeve 413, there is a ball 414 which is biased toward the sleeve 407 by means of a spring 415. The sleeve 407 which is secured to the valve member 401 is formed at its outer surface with detent grooves only one of which is shown in FIG. 8 by the reference numeral 407*a*. The detent grooves 407*a* are so located that one of them is engaged with the ball 414 when the spray nozzle 47 is either one of the aforementioned positions $Pa_1$, $Pa_2$ and $Pa_3$ to provide a clip-stop.

The rod 425 which is connected with the control knob 42*a* extends downwardly and is threadably engaged with a valve guide 427 which is fitted to a vertical bore 40*b* formed in the top wall 40*c* of the container 40. The valve guide 427 has a head 427*a* which is of a hexagonal shape and fitted to a corresponding shaped recess formed at the top end of the bore 40*b* so that the valve guide 427 is maintained against rotation in the bore 40*b*.

The top wall 40*c* of the lower container 40 is formed with a port 426 which connects the interior of the lower container 40 with the lower end of the bore 40*b* and the port 426 is formed with a valve seat 426*a* at the side facing to the bore 40*b*. At the lower end, the rod 425 is tapered as shown by 425*a* to constitute a metering valve which cooperates with the valve seat 426*a*. An annular ring 428 is fitted to the rod 425 for providing a seat for a return spring and also for preventing the rod 425 from being removed in the axial direction. O-rings 429 and 430 are provided around the rod 425 and the valve guide 427, respectively, for ensuring a required watertightness.

Figure 11:
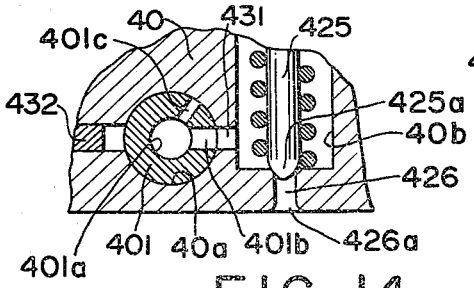
FIGS. 11 and 12 are enlarged views of the encircled area I for showing the valve operation.
Figure 12:
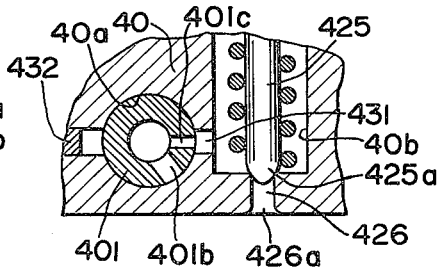

The top wall 40*c* of the lower container 40 is further formed with a passage 431 which connects the bore 40*b* with the bore 40*a*. The valve member 401 is formed with a radial passage 401*b* and a restricted radial passage 401*c* which are angularly spaced one from the other. The passages 401*b* and 401*c* are so located that the passage 401*b* is in communication with the passage 431 as shown in FIG. 11 when the valve member 401 and the pipe 46 are moved to the position wherein the spray nozzle 47 is in the first spray position $Pa_2$ and the passage 401*c* is in communication with the passage 431 as shown in FIG. 12 when the spray nozzle 47 is in the second spray position $Pa_3$.

Figure 5:
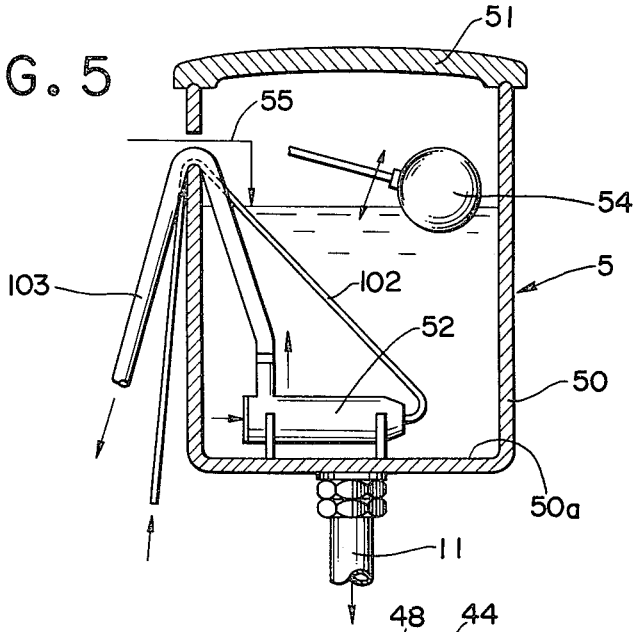
FIG. 5 is a sectional view of the flushing water tank showing the submerged pump provided therein.

Referring now to FIG. 5, the flush water tank 5 is composed of a tank vessel 50 which is located behind the toilet bowl 1 and a closure lid 51. The vessel 50 has a bottom 50*a* to which the aforementioned flushing conduit 11 is connected. In the vessel 50, there is provided a submerged water pump 52. As in conventional flushing tanks, the vessel 50 is provided with an inlet valve (not shown) which is controlled by means of a float 54 so that the vessel 50 is filled with water to a predetermined level. As usual, a flushing lever 53 is provided in the vessel 50 as shown in FIG. 1.

The submerged water pump 52 has an outlet which is connected with a water feed pipe 103. The pipe 103 is connected with an inlet port 49 of a non-return valve 433 which is provided at the bottom of the lower container 40 of the heated water reservoir 4. Thus, when the pump 52 is energized, water is supplied from the pump 52 through the pipe 103, the inlet port 49 and the non-return valve 433 to the container 40 to force the heated water in the container 40 to flow out through the opening 426 into the bore 40*b*. The flow rate through the opening 426 can be controlled by the metering valve 425*a*.

Figure 13:
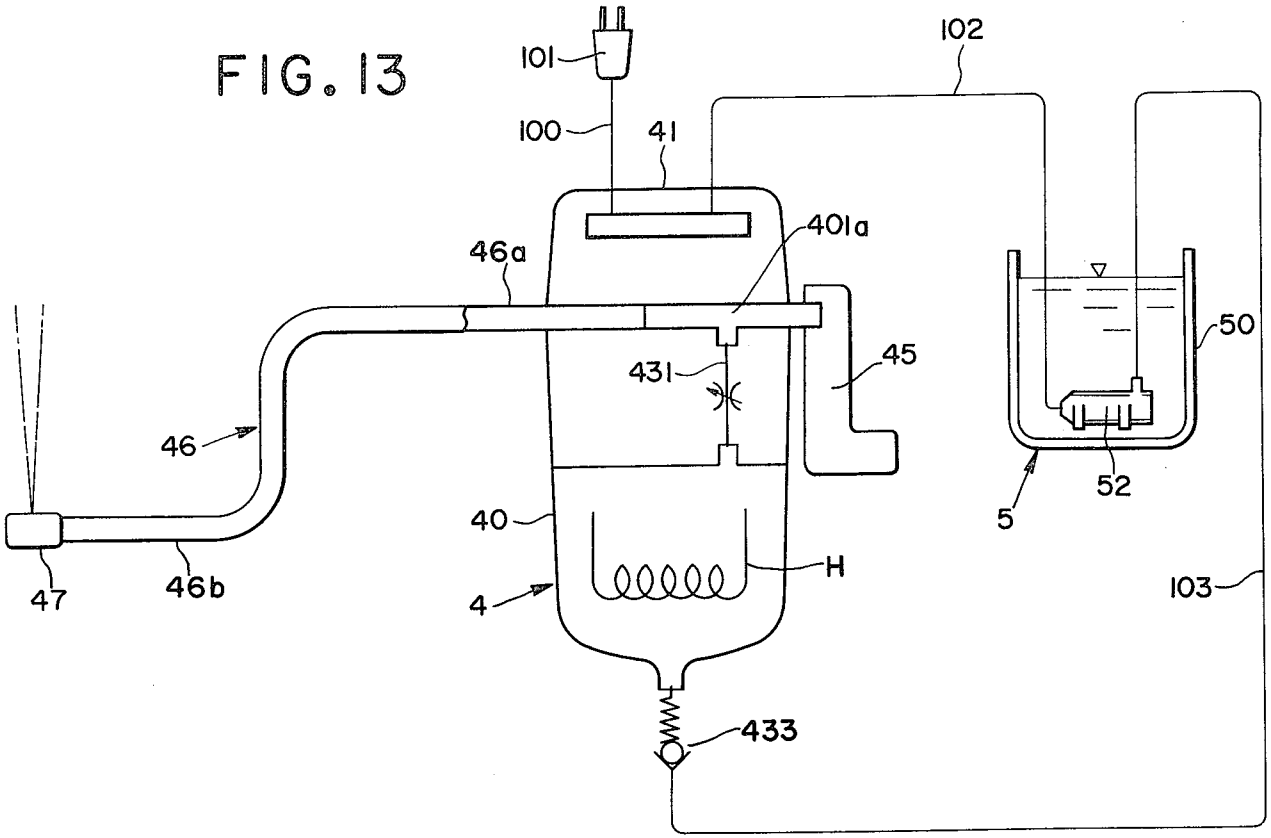
FIG. 13 is a diagram showing the conduit connections in the embodiment of the present invention; and, FIG. 14 is a diagrammatical view showing the operation of the spraying device in accordance with the present invention.

As shown in FIGS. 2 and 13, a power supply cable 100 is provided to maintain a supply of electric power. The cable 100 has one end provided with an electric plug 101 and the other end connected with a main switch 422 located in the reservoir 4 at the space between the top wall 40*c* of the lower container 40 and the cover lid 41. The main switch 422 is connected through an electric cable 102 with the submerged water pump 52 to provide an electric power supply to the pump 52.

Referring to FIG. 9, it will be noted that a return spring 418 is provided for returning the valve member 401 to the position wherein the spray nozzle 47 is in the retracted position. The spring 418 is connected at one end with a bracket 419 which is mounted on the container 40 and at the other end with a chain 420 which is in turn connected through a pin 421 to the sleeve 407 so as to bias the sleeve 407. The main switch 422 has an actuating switch arm 422*a* and is mounted on a switch bracket 423 which is provided on the container 40. In order to actuate the switch 422, the sleeve 407 is formed with a cam configuration 407*b* which is so shaped that the switch 422 is closed when the control lever 45 is actuated to position the spray nozzle 47 to the first or second spray position $Pa_1$ or $Pa_2$. The sleeve 407 is further formed with radial projections 407*c* and 407*d* which function as the extreme stops for the actuation of the control lever 45 by cooperating with a projection 424 formed on the container 40. Where necessary, a shield plate 435 may be provided for protecting the main switch 422 from splash of water. Further, grommets 501 and 502 may be provided as necessary to protect the electric cables as shown in FIG. 9. Where the seat 2 is provided with a heater, a heating power supply cable 104 may be provided as shown in FIG. 9. Further, a grounding cable 105 may also be provided.

Figure 6:
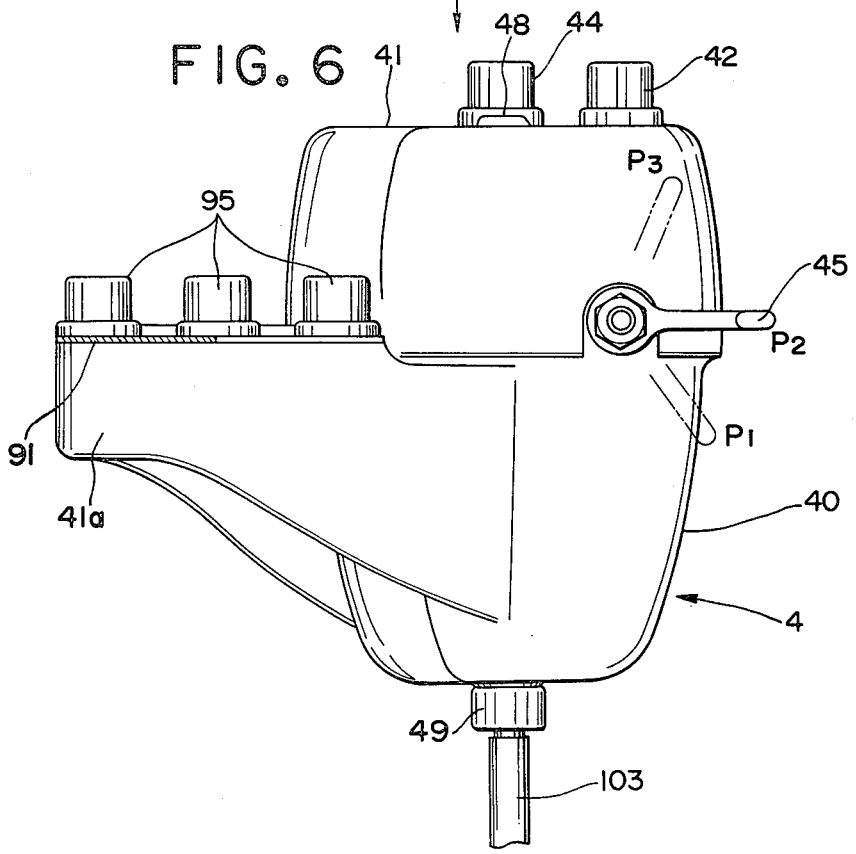
FIG. 6 is a side view of the heated water reservoir.

In use, the actuating lever 45 is moved to turn from the normal position as shown by a dotted line $P_1$ in FIG. 6 to the flushing position as shown by a solid line $P_2$ against the action of the return spring 418. The switch 422 is then actuated to the closed position by the cam surface 407*b* formed on the sleeve 407 so that the submerged pump 52 is energized. By thus actuating the lever 45, flushing water is discharged to the toilet bowl 1 from the water tank 5 as in usual flushing toilets. In addition, water is pumped through the pipe 103 and the one-way valve 433 in the inlet port 48 to the heated water reservoir 4. The water in the reservoir 4 is therefore forced to flow through the outlet port 426 formed in the container 40 and the metering valve 425*a* formed at the lower end of the rod 425 to the passage 431. In this position $P_2$ of the actuating lever 45, the passage 431 is in communication with the port 401*b* of the valve member 401. Therefore, the water from the reservoir 4 is passed from the passage 431 through the port 401*b* to the axial bore 401*a* in the valve member 401 and then through the pipe 46 to be discharged from the spray nozzle 47. The actuating lever 45 is maintained in position $P_2$ by the ball 414 which is engaging with one of the V-shaped grooves 407*a* in the sleeve 407. The vertical position of the rod 425 can be adjusted through the knob 42 to control the water flow through the metering valve 425*a* and to thereby adjust the water spray pressure through the nozzle 47.

When the lever 45 is moved further to the position shown by a dotted line $P_3$ in FIG. 6, the valve member 401 is rotated to a position wherein the passage 431 is in communication with the restricted port 401*c*. The switch 422 is of course maintained closed by the cam surface 407*b* on the sleeve 407. Water from the reservoir 4 is thus forced to flow through the restricted port 401*c* so that the water is discharged through the nozzle under a decreased pressure. This position of the lever 45 is suitable for use the device as a bidet. After use, the lever 45 is returned to the normal position $P_1$.

Figure 14:
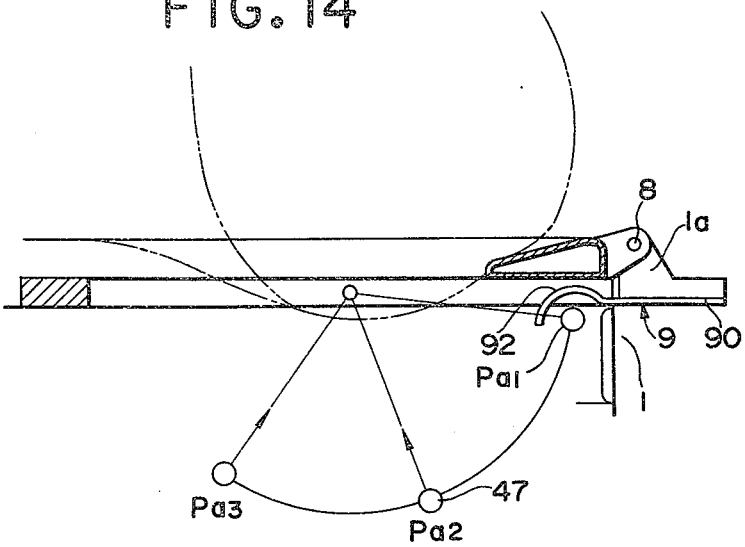

As shown in FIG. 8, the pipe 46 having the spray nozzle 47 is composed of a straight horizontal part 46*a* and a curved main part 46*b*. The straight part 46*a* is connected with the valve member 401 and extends between the top surface of the toilet bowl 1 and the seat 2. The pipe 46 is therefore rotated about the longitudinal axis of the straight part 46*a* of the pipe 46 and the spray nozzle 47 is moved between the retracted positions $Pa_1$, $Pa_2$ and $Pa_3$ as shown in FIGS. 4 and 14. The nozzle 47 may be so formed that the spray is directed to the axis of rotation of the pipe 46 whereby the water is sprayed substantially the same portion of the body both in the positions $Pa_2$ and $Pa_3$ as shown in FIG. 14.

The invention has thus been shown and described with reference to a specific embodiment, however, it should be noted that the invention is in no way limited to the details of the illustrated arrangements but changes and modification may be made without departing from the scope of the appended claims.

We claim:

1. A sanitary cleansing spraying device which comprises reservoir means for heated water, means for providing a supply of water to said heated water reservoir means, spray nozzle means provided on support means to extend into a toilet bowl and movable between first and second spray positions in which it is located in the toilet bowl so that it can direct a spray of water at first and second angles to a portion of a body sitting on the toilet bowl, and a retracted position in which it is prevented from soiling, said spray nozzle means being connected to said heated water reservoir means through flow control valve means, said flow control valve means including a movable member operable to selectively communicate said heated water reservoir means with said spray nozzle means by one of two ports of different size or to block communication between said heated water reservoir means and said spray nozzle means, manual means for moving said spray nozzle means from said retracted position to said first spray position and then to said second spray position and, at the same time, for moving said movable valve member from said blocking position to a position where said heated water reservoir is connected to said spray nozzle means by one of said ports and then by the other of said ports, and means for forcing water in the heated water reservoir means through said flow control valve means to said spray nozzle means.

2. A sanitary cleansing spray device in accordance with claim 1 which further includes second valve means between said heated water reservoir means and said spray nozzle means, said second valve means being opened by the pressure of water supplied from a flush water tank when said spray nozzle means is said first and second spray positions.

3. A sanitary cleansing spray device in accordance with claim 2 in which the water forcing means comprises water pump means provided in said flush water tank vessel, said pump means having an outlet communicated with said reservoir means at the bottom portion thereof, and water heating means provided in said reservoir.

4. A sanitary cleansing spraying device in accordance with claim 3 in which switch means is provided for energizing said water pumping means, said switch means being actuated when said spray nozzle means is moved to either of said spray positions.

5. A sanitary cleansing spraying device in accordance with claim 3 in which said heated water reservoir means includes a closed container mounted at the side of said toilet bowl, said spray nozzle means being mounted at the end of a pipe which extends from the reservoir container sidewardly to the toilet bowl.

6. A sanitary cleansing spraying device in accordance with claim 5 in which a non-return valve is provided between said heated water reservoir means and said spray nozzle means.

7. A sanitary cleansing spraying device in accordance with claim 6 in which said non-return valve is provided at the bottom of said heated water reservoir means.

* * * * *